US005652408A

United States Patent [19]

Nicolas

[11] Patent Number: 5,652,408

[45] Date of Patent: Jul. 29, 1997

[54] EXPLOSIVE PROJECTILE

[75] Inventor: Jacques Nicolas, Lecheix/Morge, France

[73] Assignee: Manurhin Defense, Versailles, France

[21] Appl. No.: 502,769

[22] Filed: Jul. 14, 1995

[30] Foreign Application Priority Data

Jul. 22, 1994 [FR] France ..... 94 09081

[51] Int. Cl.[6] ..... F42B 12/22

[52] U.S. Cl. ..... 102/499; 102/364; 102/473; 102/491; 149/38; 149/41; 149/62; 149/108.2; 86/20.14

[58] Field of Search ..... 102/364, 473, 102/491–497, 499, 500; 149/38, 41, 62, 108.2; 86/20.14

[56] References Cited

U.S. PATENT DOCUMENTS

| | | | |
|---|---|---|---|
| 109,600 | 11/1870 | Drake | 102/493 |
| 2,678,603 | 5/1954 | Prince, Jr. et al. | 102/364 |
| 2,780,995 | 2/1957 | Migliaccio | 102/364 |
| 3,421,439 | 1/1969 | Custard | 102/364 |
| 3,479,955 | 11/1969 | Birkigt | 102/500 |
| 3,532,056 | 10/1970 | Irion | 102/473 |
| 3,783,790 | 1/1974 | Polcha | 102/493 |
| 3,865,035 | 2/1975 | Munson et al. | 102/364 |
| 4,237,787 | 12/1980 | Wacula et al. | 102/364 |
| 4,462,312 | 7/1984 | Cahannes et al. | 102/364 |
| 4,648,324 | 3/1987 | McDermott | 102/364 |
| 4,903,604 | 2/1990 | Blewett et al. | 102/364 |
| 4,945,834 | 8/1990 | Young | 102/473 |
| 4,956,029 | 9/1990 | Hagel et al. | 102/202.5 |
| 5,121,691 | 6/1992 | Nicolas | 102/364 |
| 5,353,707 | 10/1994 | Duguet | 102/290 |

FOREIGN PATENT DOCUMENTS

| | | |
|---|---|---|
| 2438686 | 5/1980 | France . |
| 2664970 | 1/1992 | France . |

*Primary Examiner*—Harold J. Tudor
*Attorney, Agent, or Firm*—Oliff & Berridge

[57] ABSTRACT

An explosive projectile has a splinter-generating body inside which is placed an explosive and/or incendiary load ignited by a primer. The projectile also contains an intermediate charge placed between the primer and the explosive load. The charge is composed of a mixture of an explosive and a first pyrotechnic composition including at least one oxidizing agent and at least one reducing agent. The explosive projectile may be utilized as a medium caliber projectile ignited upon impact by a pyrotechnic fuse.

27 Claims, 2 Drawing Sheets

EXPLOSIVE PROJECTILE

FIELD OF THE INVENTION

The scope of the present invention is that of explosive projectiles, notably that of medium caliber explosive projectiles, which are ignited upon impact by means of a pyrotechnic fuse comprising at least one incendiary composition placed in a deformable nose cone.

BACKGROUND

Such an explosive projectile is known via patent FR9009111. The cone of this projectile contains incendiary compositions which are ignited upon impact on a target thereby ensuring the firing of an explosive load.

The problem with such a projectile is that the ignition of the explosive load is delayed by the slowspeed expansion of the deflagration regime of the incendiary compositions.

This delay causes a reduction in the close-range effects on the target with respect to the firing point (impact on target), and a slow increase in the deflagration regime.

SUMMARY OF THE INVENTION

The aim of the present invention is to meet such disadvantages whilst enabling the ignition delay of the explosive load to be reduced and the transient regime to be improved, which ensures a faster explosion of the projectile and therefore the faster formation of splinters following impact of the target.

The invention notably enables the functioning of projectiles ignited upon impact by means of a pyrotechnic fuse comprising at least one incendiary composition placed in a deformable nose cone to be improved.

The invention may also by applied to projectiles ignited by a conventional fuse (mechanical or electronic) comprising a primer ensuring firing by thermal effect (generation of a hot plasma). It also enables, in this case, the ignition of the explosive load to be improved thereby ensuring a faster passage into the detonating mode.

The subject of the invention is thus an explosive projectile, notably a medium caliber projectile, comprising a splinter-generating body inside which an explosive load and/or incendiary load is/are placed and subsequently ignited by a priming means, characterised in that the explosive projectile comprises an intermediate charge positioned between the priming means and the explosive load formed of a mixture of an explosive and a first pyrotechnic composition having at least one oxidizing agent and one reducing agent.

Such an arrangement provides a priming means with improved sensitivity which promotes the fast ignition of the explosive load.

DESCRIPTION OF PREFERRED EMBODIMENTS

Figure 1:
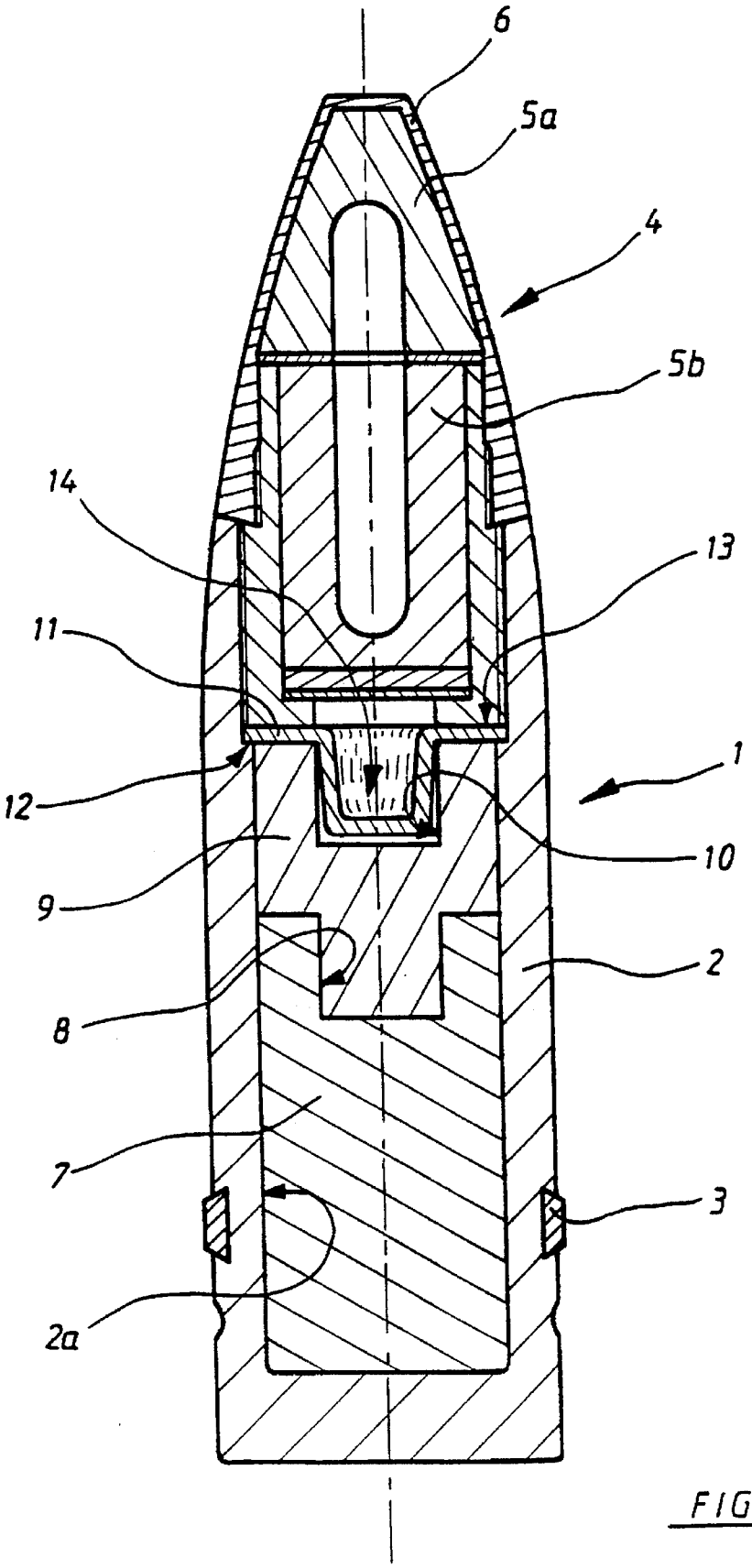
FIG. 1 shows a longitudinal cross section of a projectile according to a first embodiment of the invention.

The intermediate charge will for example comprise a homogeneous mixture of 20% to 70% of the first pyrotechnic composition and 80% to 30% of explosive.

The explosive of the intermediate charge will, with advantage, comprise a secondary explosive and a metallic powder.

The explosive of the intermediate charge could for example comprise 70% to 90% of secondary explosive, 10% to 30% of metallic powder, and 0% to 3% of binder.

The secondary explosive of the charge will notably be selected from among the following compounds: cyclonite, and homocyclonite.

The metallic powder is preferably an aluminium powder with a size grading of between 300 and 500 micrometers.

The first pyrotechnic composition of the intermediate charge comprises, with advantage, 40% to 80% of oxidizing agent and 60% to 20% of reducing agent.

The oxidizing agent will be selected from among the following compounds or a mixture of them: barium nitrate, potassium nitrate, barium chlorate, potassium perchlorate, barium perchlorate, and barium peroxide.

The reducing agent will be selected from among the following compounds, a mixture of them or their intermetallic alloys: aluminium powder, magnesium powder, uranium powder, and silicon powder.

According to an actual embodiment, the first pyrotechnic composition of the intermediate charge comprises:

30% to 50% of barium nitrate,

10% to 30% of barium chlorate,

10% to 30% of an aluminium/magnesium alloy,

10% to 30% in the aggregate of strained magnesium (fine size grading, for example less than 300 microns).

According to another characteristic of the invention, the explosive load comprises at least one axial cavity in which the intermediate charge penetrates, a cavity designed to increase the surface contact between the explosive load and the intermediate charge.

Such a configuration, by increasing the contact surfaces between the intermediate charge and the explosive load enables the ignition delay of the explosive load to be reduced.

The intermediate charge could be placed loose or lightly packed in the axial cavity.

The intermediate charge may also be cast or compressed and will comprise at least one axial hole placed facing a priming means.

This configuration increases the contact surfaces between the intermediate charge and the plasma provided by the priming means, which also enables the ignition delay of the explosive load to be reduced.

According to another characteristic, a second pyrotechnic composition is placed in the axial hole or holes in the intermediate charge.

This second pyrotechnic composition is, with advantage, placed loose or very lightly packed in the axial hole or holes.

The presence of a very lightly packed second pyrotechnic composition also enables the contact surface between the plasma and the second pyrotechnic composition to be increased.

According to a particular embodiment, the second pyrotechnic composition has the same formula as the intermediate charge.

According to another characteristic of the invention, a barrier made of a combustible material is set between the priming means and the intermediate charge.

The presence of a barrier ensures confinement of the priming means which enables the plasma, resulting from the ignition means, to be pressurized.

Such an arrangement improves the priming of the intermediate charge.

In practice, the barrier will be between 0.05 and 0.3 mm thick and will be made of nitrofilm, propergol or kraft paper.

According to alternative embodiments, the barrier is disc-shaped, or has at least one concave area penetrating at least partially in the axial hole or holes of the intermediate charge.

The splinter-generating body will, with advantage, have undergone a structural treatment promoting the formation of splinters, for example tempering, electron bombardment or laser spot-heating.

According to a preferred embodiment, the priming means are composed of a pyrotechnic fuse comprising at least one incendiary composition placed in an deformable nose cone.

Other advantages will become apparent from reading the following description made in reference to the appended drawings.

With reference to FIG. 1, a projectile 1 according to the invention comprises a metallic body 2 carrying at its rear a drive band 3 and on its front part a priming means 4 composed of a pyrotechnic fuse fastened to the body by threading.

The pyrotechnic fuse comprises two incendiary compositions 5*a*, 5*b* placed in a deformable nose cone 6. Such a fuse is described in detail in patent FR9009111 and its structure will not be explained further here.

The body 2, made of steel or aluminium, will preferably have undergone a structural treatment promoting the formation of splinters, for example tempering, electron bombardment or laser spot-heating. Bombardment and spot-heating will be carried out on longitudinal and circular generating lines so as to define a mesh of required splinters (such a process is described in patent FR7829211).

The body 2 might also comprise preformed splinters.

The body 2 of the projectile contains an explosive load 7 of a known type, comprising for example a secondary explosive such as cyclonite or homocyclonite, and which may with advantage comprise a charge of metallic powder (such as aluminium) to reinforce its pyrophoric properties (such mixtures having cyclonite or homocyclonite with aluminium are commercialised under the respective brand names Hexal or Octal).

The explosive load will be put into place by casting, compression or injection.

A cylindrical axial cavity 8 will be arranged on the upper part of the explosive load. In the case of shaping by compression, a bradawl having the required shape merely has to be used in the last stage of compression.

In the case of a cast, the cavity will be machined.

The height and diameter of the cavity will usually fall between one half and one sixth of the diameter of the bore 2*a* of the body 2.

The body 2 also contains an intermediate charge 9 placed between the priming means 4 and the explosive load 7.

This intermediate charge is formed of a mixture of an explosive and a first pyrotechnic composition having at least one oxidizing agent and at least one reducing agent.

To make the intermediate charge a homogeneous mixture of 30% to 70% of pyrotechnic composition and 70% to 30% of explosive will preferably be selected.

The explosive can be a known secondary explosive such as cyclonite or homocyclonite or else an explosive loaded with metallic powder such as aluminium (Hexal or Octal).

Advantageously and so as to simplify the production the same explosive will be selected as that which forms the load 7.

The first pyrotechnic composition will comprise for example 40% to 80% of oxidizing agent and 60% to 20% of reducing agent.

The role of this composition is to facilitate ignition of the secondary explosive with which it is mixed. This ignition is a result of a significant rise in temperature, which makes the displacement velocity of the wave front of a regime under 2000 m/s to one which is over 2000 m/s, thus causing "the detonation" of all or part of the secondary explosive.

The oxidizing agent will be selected from among the following compounds or a mixture of them: barium nitrate, potassium nitrate, barium chlorate, potassium perchlorate, barium perchlorate, and barium peroxide.

The reducing agent will be selected from among the following compounds, a mixture of them or their intermetallic alloys: aluminium powder, magnesiums powder, uranium powder, and silicon powder.

A first pyrotechnic composition of the intermediate charge comprising the following may for example be used:

30% to 50% of barium nitrate,

10% to 30% of barium chlorate,

10% to 30% of an aluminium/magnesium alloy,

10% to 30% of strained magnesium (fine size grading, for example less than 300 microns).

An intermediate charge comprising 30% to 70% of this composition mixed with 70% to 30% of Hexal is particularly well suited to ignite a Hexal type explosive.

The intermediate charge can be put into place by casting or compression. It will fill up the axial cavity 8 of the explosive load.

Such an arrangement enables the contact surface between the charge 9 and the load 7 to be increased thereby improving ignition of the latter by the intermediate charge 9.

The intermediate charge 9 comprises an axial hole 10 which is placed opposite the priming means 4 and which in this example is roughly of the same diameter as the cavity 8.

This hole 10 may for example be obtained during the compression of the intermediate charge 9 by means of a bradawl having a special shape.

The purpose of this hole is to increase the surface area of the charge 9 which will be subjected to the plasma generated by the priming means.

The priming of the charge 9 is thus improved which reduces the time required for this priming.

As an alternative it is possible to give a different diameter to the hole 10 and to the cavity 8. By modifying the diameter and/or depth of the hole 10 the ignition delay of the intermediate charge 9 may be adjusted. Several holes 10 might also be arranged.

The height and depth of the hole 10 will usually fall between one half and one sixth of the diameter of the bore 2*a* of the body 2.

It will also be possible to adapt a given intermediate charge 9 to a given explosive load 7 by changing the diameter and/or depth of the cavity 8. Several cavities 8 might also be arranged.

A barrier 11 made of a combustible material is placed on the intermediate charge 9. This barrier may for example be made of nitrofilm, nitrocellulose, propergol or kraft paper.

The barrier is held in place by being squeezed between the lower face 13 of the priming means 4 and a shoulder 12 of the body 2.

It has a central concave area 14 which penetrates in the axial hole 10 in the intermediate charge 9.

This barrier insulates the intermediate charge 9 from the priming means 4. It ensures a temporary confinement which ensures the pressurizing of the plasma (hot gases and incandescent particles) resulting from the priming means 4.

When the pressure and the caloric effect are high enough, the plasma passes through the barrier and comes into contact with the intermediate charge 9. This action of the barrier enables the priming of the intermediate charge to be improved, the reliability of this ignition and the reproducibility of the moment of ignition from one projectile to another to be increased.

A barrier thickness of between 0.05 and 0.3 mm will preferably be selected.

Because of the insulation which it provides, the barrier 11 also improves the safety of the projectile by preventing any contact between the detached particles of the intermediate charge 9 and the priming means 4 (particles which may become detached as a result of the constraints associated with storage, transport and introduction of the projectile into the launcher).

The special concave shape given to the barrier enables the latter to ensure a mechanical hold of the particles of the charge 9 which may possibly become detached around the hole 10.

By roughly covering the entirety of the inner surface of the hole 10, this concave shape ensures the confinement of the ignition plasma within the hole.

The ignition of the charge 9 is thus achieved in a homogeneous manner on the entirety of the surface area of the hole which increases the reliability and reproducibility of the ignition.

Figure 2:
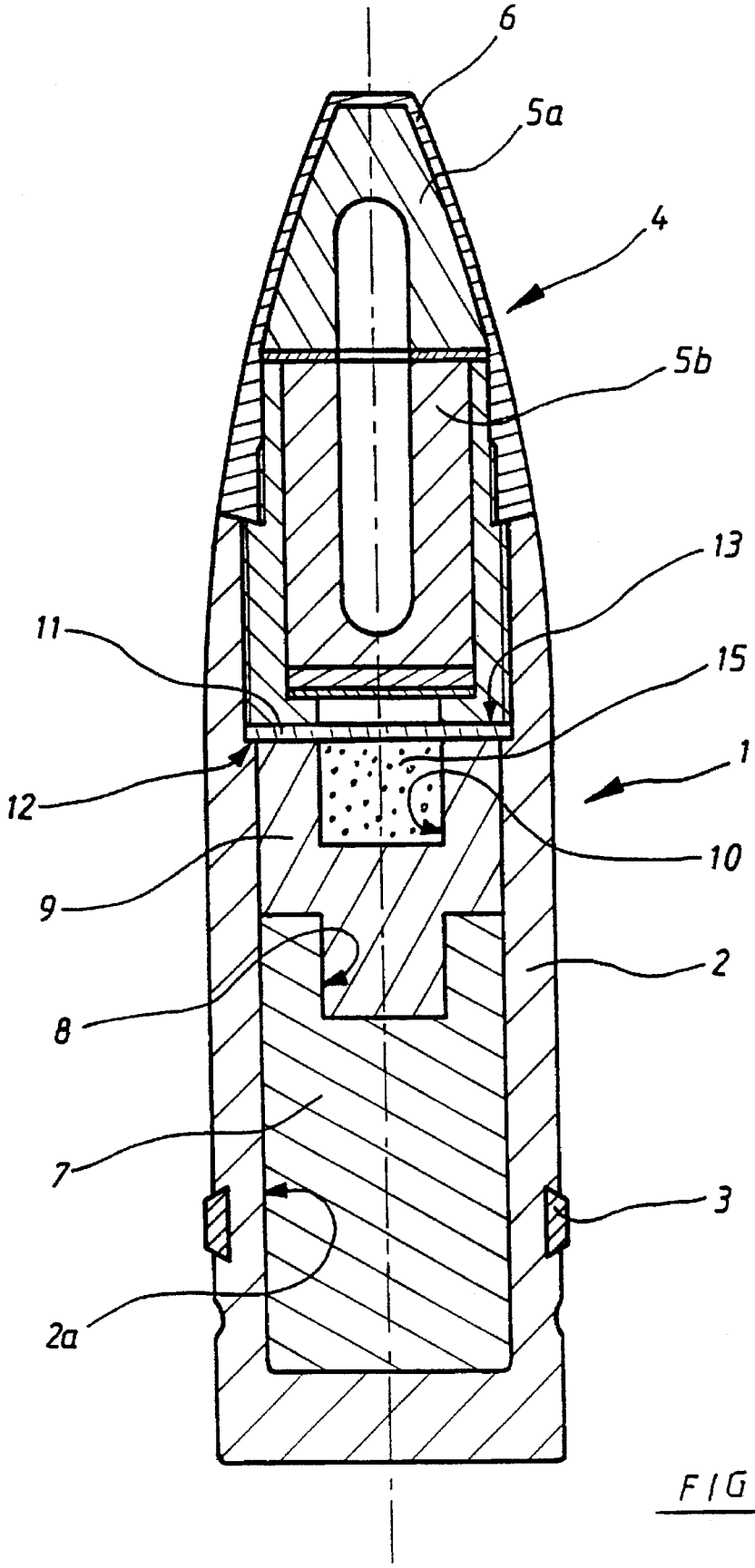
FIG. 2 shows a longitudinal cross section of a projectile according to a second embodiment of the invention.

FIG. 2 shows another embodiment of a projectile according to the invention.

This embodiment differs from the preceding one in that the hole 10 is completely filled with a second pyrotechnic composition 15 placed in the hole, which may be loosely placed or lightly packed.

This pyrotechnic composition 15 is selected with an identical formula to that of the intermediate charge 9.

Such an arrangement enables the contact surface area between the plasma generated by the priming means and the second pyrotechnic composition to be increased thereby reducing even further the ignition delay of the intermediate charge 9.

The placing of composition 15 inside the hole 10 promotes the formation of ignition plasma.

Moreover the number of hot particles is thus increased (aluminium grains of the composition 15) which come to impact on the inner surface of the hole 10. The multiplication of incandescent impacts on the intermediate charge 9 improves ignition of the latter.

In this embodiment, the barrier 11 is shaped like a flat disc held in place by being squeezed between the lower face 13 of the priming means 4 and the shoulder 12 of the body 2.

As above, it ensures the confinement of the plasma resulting from the priming means and it also prevents any contact between the particles of the second pyrotechnic composition 15 and the priming means 4.

As an alternative it is possible to select a formula to make the second composition 15 other than that of the intermediate charge 9. For example, the composition may be one that is more or less sensitive to flames. It is thus possible to regulate with precision the moment of ignition of the intermediate charge.

It is also possible to partly fill the hole 10 with this composition. In this case a barrier having a concave central area will be used so as to ensure the retention of the second composition 15.

Lastly, it is possible to modify the sensitivity of the second composition 15 by lightly packing it.

As an alternative embodiment of the invention, it is possible to put all the charge 9 in place either loosely or lightly packed. It will therefore fill the cavity 8 as previously described and will be held in place by a barrier such as that shown in FIG. 2.

Such an alternative enables the loading operations to be made simpler. Loose packing increases the contact surface area of the priming plasma with the intermediate charge.

The invention may also be implemented when the priming means is of a different nature, for example when it is formed of a mechanical or electronic fuse comprising a primer ensuring firing by thermal effect (generation of a hot plasma). In this case the explosive load is initiated in the detonating regime via a deflagrating thermal effect supplied by the priming means as described above.

What is claimed is

1. An explosive projectile, comprising a splinter-generating body inside which at least one of an explosive load and an incendiary load is placed and ignited by a primer, an explosive intermediate charge positioned between the primer and the explosive load or incendiary loads, said intermediate charge being formed of a mixture of an explosive and a first pyrotechnic composition comprising at least one oxidizing agent and at least one reducing agent.

2. A projectile according to claim 1, wherein the intermediate charge comprises a homogeneous mixture of 20% to 70% of the first pyrotechnic composition and 80% to 30% of explosive.

3. A projectile according to claim 1, wherein the explosive of the intermediate charge comprises a secondary explosive and a metallic powder.

4. A projectile according to claim 3, wherein the explosive of the intermediate charge comprises 70% to 90% of secondary explosive, 10% to 30% of metallic powder, and 0% to 3% of binder.

5. A projectile according to claim 4, wherein the secondary explosive of the intermediate charge is selected from the group consisting of cyclonite and homocyclonite.

6. A projectile according to claim 4, wherein the metallic powder is an aluminum powder with a size grading of between 300 and 500 micrometers.

7. A projectile according the claim 1, wherein the first pyrotechnic composition of the intermediate charge comprises 40% to 80% of oxidizing agent and 60% to 20% of reducing agent.

8. A projectile according to claim 7, wherein the oxidizing agent is selected from the group consisting of barium nitrate, potassium nitrate, barium chlorate, potassium perchlorate, barium perchlorate, barium peroxide and a mixture thereof.

9. A projectile according to claim 7, wherein the reducing agent is selected from the group consisting of aluminum powder, magnesium powder, uranium powder, silicon powder, mixtures thereof and intermetallic alloys thereof.

10. A projectile according to claim 7, wherein the first pyrotechnic composition of the intermediate charge comprises:

30% to 50% of barium nitrate,

10% to 30% of barium chlorate,

10% to 30% of an aluminum/magnesium alloy, and

10% to 30% of strained magnesium.

11. A projectile according to claim 1, wherein the explosive load comprises at least one axial cavity in which the intermediate charge penetrates, said cavity being designed to increase the surface contact between the explosive load and the intermediate charge.

12. A projectile according to claim 1, wherein the intermediate charge is placed loose or lightly packed.

13. A projectile according to claim 1, wherein the intermediate charge is cast or compressed and comprises at least one axial hole placed facing the primer.

14. A projectile according to claim 13, wherein a second pyrotechnic composition is placed in the at least one axial hole in the intermediate charge.

15. A projectile according to claim 14, wherein the second pyrotechnic composition is placed loose or very lightly packed in the at least one axial hole.

16. A projectile according to claim 14, wherein the second pyrotechnic composition is composed of the same material as the intermediate charge.

17. A projectile according to claim 1, wherein a barrier made of a combustible material is set between the primer and the intermediate charge.

18. A projectile according to claim 17, wherein the barrier is between 0.05 and 0.3 mm thick and is selected from the group consisting of nitrofilm, propergol and kraft paper.

19. A projectile according to claim 17, wherein the barrier is disc-shaped.

20. A projectile according to claim 13 wherein a barrier made of a combustible material is set between the priming means and the intermediate charge and has at least one concave area penetrating at least partially in the at least one axial hole of the intermediate charge.

21. A projectile according to claim 1, wherein the splinter-generating body undergoes a structural treatment promoting the formation of splinters.

22. A projectile according to claim 1, wherein the primer is composed of a pyrotechnic fuse comprising at least one incendiary composition placed in a deformable nose cone.

23. A projectile according to claim 21, wherein said structural treatment comprises tempering, electron bombardment or laser spot-heating.

24. A method of making an explosive projectile comprising:

a) forming a splinter-generating body having therein an explosive load or incendiary load and a primer; and b) forming an explosive intermediate charge positioned between said primer and said explosive load or incendiary load, said intermediate charge comprising a mixture of an explosive and a first pyrotechnic composition and said pyrotechnic composition comprising at least one oxidizing agent and at least one reducing agent.

25. A method according to claim 24, wherein said splinter-generating body is structurally treated to promote the formation of splinters.

26. A method according to claim 25, wherein said splinter-generating body is structurally treated by tempering, electron bombardment or laser-spot heating.

27. A method according to claim 24, wherein said splinter-generating body comprises preformed splinters.

* * * * *